US007776162B2

(12) United States Patent
Mizoguchi et al.

(10) Patent No.: US 7,776,162 B2
(45) Date of Patent: Aug. 17, 2010

(54) STEELS WITH FEW ALUMINA CLUSTERS

(75) Inventors: Toshiaki Mizoguchi, Tokai (JP); Yoshiyuki Ueshima, Tokai (JP); Jun Yamaguchi, Tokai (JP); Yu Watanabe, Tokai (JP); Akira Mikasa, Tokai (JP); Hirotsugu Yasui, Tokai (JP)

(73) Assignee: Nippon Steel Corporation, Tokyo (JP)

( * ) Notice: Subject to any disclaimer, the term of this patent is extended or adjusted under 35 U.S.C. 154(b) by 528 days.

(21) Appl. No.: 10/521,950

(22) PCT Filed: Jul. 22, 2003

(86) PCT No.: PCT/JP03/09274

§ 371 (c)(1),
(2), (4) Date: Sep. 29, 2005

(87) PCT Pub. No.: WO2004/009854

PCT Pub. Date: Jan. 29, 2004

(65) Prior Publication Data

US 2006/0260719 A1 Nov. 23, 2006

(30) Foreign Application Priority Data

Jul. 23, 2002 (JP) ..... 2002-214160
Jul. 23, 2002 (JP) ..... 2002-214161
Jun. 12, 2003 (JP) ..... 2003-167831

(51) Int. Cl.
*C22C 38/06* (2006.01)
*C21C 7/06* (2006.01)

(52) U.S. Cl. ..... 148/331; 75/568

(58) Field of Classification Search ..... 75/560, 75/567, 568; 148/331, 320–327
See application file for complete search history.

(56) References Cited

U.S. PATENT DOCUMENTS 2,980,529 A * 4/1961 Knapp et. al. ..... 75/568
3,623,862 A * 11/1971 Spengler et al. ..... 75/565

(Continued)

FOREIGN PATENT DOCUMENTS

EP 0 829 546 3/1998

(Continued)

OTHER PUBLICATIONS

Shirota et al. "Development of Production Process of Highly Clean Steel" CAMP-ISIJ, vol. 4 (1991), p. 1214-1217.

(Continued)

*Primary Examiner*—George Wyszomierski
*Assistant Examiner*—Mark L Shevin
(74) *Attorney, Agent, or Firm*—Kenyon & Kenyon LLP

(57) ABSTRACT

A steel having few alumina clusters prepared by casting liquid steel deoxidized with Al, with the addition of one or more rare-earth metals (REM) selected from the group of Ce, La, Pr and Nd in which:

(a) The REM-oxide-content in oxide-based inclusions consisting mainly of alumina and REM-oxides is 0.5 to 15 mass % of said oxide-based inclusions, or (b) The mass ratio of total REM to total oxygen (T.O.), REM/T.O., in liquid steel is not less than 0.05 and not more than 0.5, in addition to (a), or (c) The total REM-content is not less than 0.1 ppm and less than 10 ppm and the dissolved-REM-content is less than 1 ppm.

6 Claims, 3 Drawing Sheets

U.S. PATENT DOCUMENTS

| | | | | | |
|---|---|---|---|---|---|
| 4,042,381 | A | * | 8/1977 | Thomas et al. | 420/83 |
| 4,440,568 | A | * | 4/1984 | Staggers et al. | 75/305 |
| 4,880,480 | A | * | 11/1989 | Kokubo et al. | 148/320 |
| 6,120,578 | A | * | 9/2000 | Nakato et al. | 75/568 |
| 6,221,180 | B1 | * | 4/2001 | Tosaka et al. | 148/320 |
| 6,344,093 | B1 | * | 2/2002 | Ohmori et al. | 148/320 |

FOREIGN PATENT DOCUMENTS

| | | | | |
|---|---|---|---|---|
| EP | 0 906 960 | | | 4/1999 |
| EP | 0 906 960 | A1 | * | 7/1999 |
| EP | 1029938 | | * | 8/2000 |
| JP | 52-70918 | | | 6/1977 |
| JP | 52-070918 | | * | 6/1977 |
| JP | 56-005915 | | | 1/1981 |
| JP | 56-047510 | | | 4/1981 |
| JP | 7-70638 | | | 3/1995 |
| JP | 09-192799 | | | 7/1997 |
| JP | 10-183229 | | | 7/1998 |
| JP | 11-264048 | | | 9/1999 |
| JP | 11-323426 | | | 11/1999 |
| JP | 2000-144330 | | | 5/2000 |
| JP | 2000-273524 | | | 10/2000 |
| JP | 2001-26842 | | | 1/2001 |
| JP | 2002-105527 | | | 4/2002 |

OTHER PUBLICATIONS

Yasunaka et al. "Pinhole and Inclusion Defects Formed at the Subsurface in Ultra Low carbon Steel" The Iron and Steel Institute of Japan, vol. 81 (1995), No. 5 p. 17-22.

H. Yin et al. ""In-situ" Observation of Collision, Agglomeration and Cluster Formation of Alumina Inclusion Particles on Steel Melts", ISIJ International, vol. 37 (1997), No. 10, p. 936-945.

"Rapid Evaluation of Inclusion in Steel with the use of Cold crucible" CAMP-ISIJ, vol. 14 (2001), p. 817-819.

* cited by examiner

STEELS WITH FEW ALUMINA CLUSTERS

TECHNICAL FIELD

The present invention-relates to steels, with few alumina clusters, suited for automotive and structural sheets, wear-resisting plates, oil-well tubes and other applications.

BACKGROUND ART

Steel sheets and other rolled steels are generally manufactured as Al-killed steels prepared by deoxidizing liquid steels, melted in basic oxygen furnaces, with Al. Alumina formed during deoxidation is hard, tends to form clusters and remains in liquid steel as inclusions of not smaller than several hundred μm.

If such inclusions are not adequately removed from liquid steels, they cause slivers in steel sheets, quality inferiority of structural steel plates, a decrease in low-temperature toughness of wear-resisting steel plates, weld defects in oil-well steel tubes detected by UST (ultrasonic testing) and other defects. Alumina also adheres to and builds up on the inner wall of immersion nozzles during continuous casting and causes nozzle clogging.

Alumina has conventionally been removed from liquid steels by (1) adding Al as a deoxidizer when liquid steel is tapped from the converter so that as much time as possible can be given to the agglomeration, coalescence and floating and separation of alumina from liquid steel after deoxidation, (2) accelerating the flotation and separation of alumina by vigorously stirring liquid steel by CAS (composition adjustment by sealed argon bubbling) or RH (Rheinstahl Huttenwerke und Heraus; vacuum degassing) secondary refining processes, or (3) reforming and rendering innocuous alumina to low-melting inclusion $CaO—Al_2O_3$ by adding Ca to liquid steel.

However, floating and separating alumina by said methods (1) and (2) involve a problem that the methods cannot completely remove inclusions not smaller than several hundred μm and prevent slivers on the surface of steel sheets.

Reforming inclusions by said method (3) is capable of preventing the formation of clusters and refining inclusions lowering the melting point thereof.

In order to modify alumina in liquid steel to liquid Ca-aluminate, however, Shirota et al. (refer to Materials and Processes, 4 (1991), p. 1214) say that it is necessary to control the [Ca]/[T.O.] ratio to within the range between 0.7 and 1.2.

In order to conform to this requirement, it is necessary to add, when, for example, T.O. (total oxygen, which is the sum of dissolved oxygen and oxygen in inclusions) is 40 ppm, as much as 28 to 48 ppm Ca to liquid steel.

In steel cords for tires and valve springs, meanwhile, it is generally known to modify and render innocuous inclusions to low-melting $CaO—SiO_2—Al_2O_3$ (—MnO) type inclusions that are apt to deform during rolling and working.

Still, said method (3) has not been put into practical use in the manufacture of cold-rolled steel sheets for automobiles and cans whose upper limit of Si-content is strictly controlled as Ca is added in the form of low-cost Ca—Si alloys.

There are some known liquid steel deoxidizing methods that use Ce, La or another REM (rare-earth metal). (1) One method based on Al-killing uses REM as alumina modifier after Al-deoxidation and (2) another method uses REM as deoxidizer either singly or in combination with Ca, Mg, etc., without using Al.

As a method based on Al-killing, Japanese Unexamined Patent Publication (Kokai) No. 52-70918 discloses a method for manufacturing clean steel containing few nonmetallic inclusions that removes alumina clusters from liquid steel by causing them to float and separate by controlling the interfacial tension between liquid steel and alumina clusters by adding one or more of Se, Sb, La and Ce of 0.001 to 0.05% after deoxidation with Al or Al—Si, sometimes in combination with stirring of liquid steel.

Japanese Unexamined Patent Publication (Kokai) No. 2001-26842 discloses cold-rolled steel sheets having excellent surface and internal properties and manufacturing method therefore that controls the size of oxide inclusions to 50 μm or under and the composition of said inclusions to Al-oxide of 10 to 30 wt %, Ca-oxide and/or REM of 5 to 30 wt %, and Ti-oxide of 50 to 90 wt %, by adding Ca and/or REM after deoxidizing liquid steel with Al and Ti.

Furthermore, Japanese Unexamined Patent Publication (Kokai) No. 11-323426 discloses a method for manufacturing clean Al-killed steel with no alumina clusters and few defects by applying composite deoxidation with Al, REM and Zr.

However, these methods have been unable to decrease inclusions defects to desired quality levels because it has been difficult to surely float and separate alumina clusters.

Japanese Patent No. 1150222-discloses a method for manufacturing steel that lowers the melting point of inclusions, and softens the inclusions, by adding an alloy containing one or more of Ca, Mn and REM, for example, of 100 to 200 ppm, after deoxidizing liquid steel with a flux containing Ca-oxide.

Japanese Patent No. 1266834 discloses a method for manufacturing steel wire rods with excellent fine drawability that adds REM of 50 to 500 ppm after controlling T.O. (total oxygen) to 100 ppm or under with a deoxidizer such as Mn or Si, other than Al, with a view to prevent oxidation by air.

However, these methods involve the problem of a cost increase because they do not use low-priced Al as deoxidizer. Deoxidation with Si, according to these methods, is difficult to apply to liquid steel for sheet steels whose upper limit of Si-content is strictly controlled.

Meanwhile, several formation mechanisms have been proposed regarding clustering of alumina particles.

For example, Japanese Unexamined Patent Publication (Kokai) No. 9-192799 discloses that adhesion of $Al_2O_3$—particles to immersion nozzles can be prevented by lowering the bonding force of $P_2O_5$, which is as binder of $Al_2O_3$, by forming $nCaO.mP_2O_5$ by adding Ca to liquid steel, based on the knowledge that $P_2O_5$ in liquid steel encourages the agglomeration and coalescence of $Al_2O_3$.

Yasunaka et al. (Tetsu to Hagane [Iron and Steel], (1995), p. 17) conjecture that alumina particles captured by Ar gas bubbles, which are used for prevention of immersion nozzle clogging in continuous casting, causes slivers in cold-rolled steel sheets.

H. Yin et al. (ISIJ Int., 37 (1997), p. 936 discloses the observation that alumina particles captured by gas bubbles agglomerate and coalesce due to a capillary effect at the surface thereof.

While the forming mechanism of alumina clusters are being elucidated, no concrete methods to prevent clustering have vet been found. It has therefore been difficult to decrease inclusion defects to desired quality levels.

SUMMARY OF THE INVENTION

The present invention was made to advantageously solve the conventional problems described above. The present invention was completed with a view to providing steels having fewer surface and internal defects, such as slivers in steel sheets for automobiles and household electrical appliances, quality inferiority in structural steel plates, a drop in low-temperature toughness in wear-resisting steel plates and weld defects in oil-well steel tubes detected by UST (ultrasonic testing), by preventing the formation of coarse alumina clusters, which constitute the cause of product defects in the manufacture of steel sheets, plates, tubes and pipes, shapes, bars and other steel products, in liquid steel and at the surface of argon gas bubbles.

In order to solve the above-described problems, the inventor conducted a series of experiments and studies that led to the following discoveries. (i) Low-melting oxides FeO and $FeO.Al_2O_3$ are present as binders between alumina particles in clusters. (ii) Agglomeration and coalescence of alumina particles in liquid steel and at the surface of Ar gas bubbles are preventable by reducing such binders by appropriate quantities of REM. (iii) If more than a necessary quantity of dissolved REM remain in liquid steel, large quantities of composite oxides comprising REM-oxide and alumina are formed by reaction between liquid steel and slags and impair the cleanliness of the liquid steel.

The gist of the present invention that was made based on the above findings is as follows:

(1) A steel prepared by casting liquid steel deoxidized with Al including one or more rare-earth metals (REMs) selected from the group of Ce, La, Pr and Nd, is characterized by, containing fewer alumina clusters in which oxide-based inclusions consisting mainly of alumina and REM-oxide contain REM-oxide of not less than 0.5 mass % and not more than 15 mass %.

(2) A steel prepared by casting liquid steel deoxidized with Al, including one or more rare-earth metals (REMs) selected from the group of Ce, La, Pr and Nd, is characterized by, containing fewer alumina clusters in which the mass ratio of total REM to total oxygen (T.O.), i.e. REM/T.O., is not less than 0.05 and not more than 0.5, and oxide-based inclusions consisting principally of alumina and REM-oxide contain REM-oxide of not less than 0.5 mass % and not more than 15 mass %.

(3) A steel prepared by casting liquid steel deoxidized with Al, including one or more rare-earth metals (REMs) selected from the group of Ce, La, Pr and Nd, is characterized by, including total REM of not less than 0.1 ppm and less than 10 ppm and dissolved REM of less than 1 ppm.

(4) The steel containing fewer alumina clusters described in any of (1) to (3) above, in which said steel comprises C of 0.0005 to 1.5 mass %, Si of 0.005 to 1.2 mass %, Mn of 0.05 to 3.0 mass %, P of 0.001 to 0.1 mass %, S of 0.0001 to 0.05 mass %, Al of 0.005 to 1.5 mass %, and T.O. of less than 80 ppm, with the remainder comprising iron and unavoidable impurities.

(5) The steel containing fewer alumina clusters described in (4) above, in which said steel further contains one or more of Cu of 0.1 to 1.5 mass %, Ni of 0.1 to 10.0 mass %, Cr of 0.1 to 10.0 mass % and Mo of 0.05 to 1.5 mass %

(6) The steel containing fewer alumina clusters described in (4) or (5) above, in which said steel further contains one or more of Nb of 0.005 to 0.1 masse, V of 0.005 to 0.3 mass % and Ti of 0.001 to 0.25 mass %.

(7) The steel containing fewer alumina clusters described in any of (4) to (6) above, in which said steel further contains B of 0.0005 to 0.005 mass %.

(8) The steel containing fewer alumina clusters described in any of (1) to (3) above, in which the maximum diameter of alumina clusters obtained by applying slime extraction to said steel is less than 100 μm.

(9) The steel containing fewer alumina clusters described in (8) above, in which the number of alumina clusters not smaller than 20 μm is not more than 2/kg.

THE MOST PREFERRED EMBODIMENT

Preferred embodiments of the present invention are described in the following.

The present invention described in (1) above (hereinafter referred to the present invention (1)) controls the REM-oxide-content in oxide-based inclusions consisting principally of alumina and REM-oxides to 0.5 to 15 mass % by adding one or more rare-earth metals (REMs) selected from the group of Ce, La, Pr and Nd to liquid steel deoxidized with Al.

When REM-oxide-content is controlled within this range, agglomeration and coalescence of alumina particles can be inhibited and formation of coarse alumina clusters prevented. It is preferable to control the REM-oxide-content in oxide-based inclusions to 2 to 12 mass %.

The rare-earth elements used in this invention range from La, atomic number 57, to Lu, atomic number 71.

Figure 1:
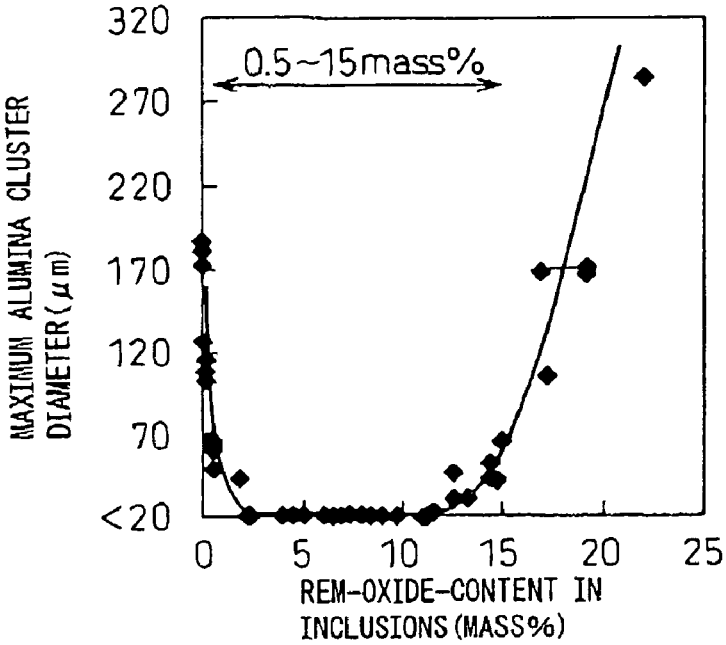
FIG. 1 shows the relationship between the content of REM-oxides in oxide-based inclusions and the maximum diameter of alumina clusters.

The upper limit of the REM-oxide-content in oxide-based inclusions is set to 15% because inclusions tend to agglomerate and coalesce and coarse clusters tend to form if the REM-oxide-content exceeds 15%, as shown in FIG. 1.

Meanwhile, the lower limit of the REM-oxide-content is set to 0.5% because addition of REM does not bring about the desired effect to prevent the clustering of alumina particles if the content is under 0.5%, as also shown in FIG. 1.

The present invention described in (2) above (hereinafter referred to the present invention (2)) surely prevents clustering of alumina by controlling the REM-oxide-content in oxide-based inclusions to 0.5 to 1.5 mass % and the mass ratio of total REM to total oxygen (T.O.), i.e. REM/T.O., in steel to 0.05 to 0.5 by adding one or more rare-earth metals (REMs) selected from the group of Ce, La, Pr and Nd to liquid steel deoxidized with Al or a combination of Al and Si.

To prevent the clustering of alumina more surely, it is preferable to control the REM/T.O. ratio to between 0.15 and 0.4.

Figure 2:
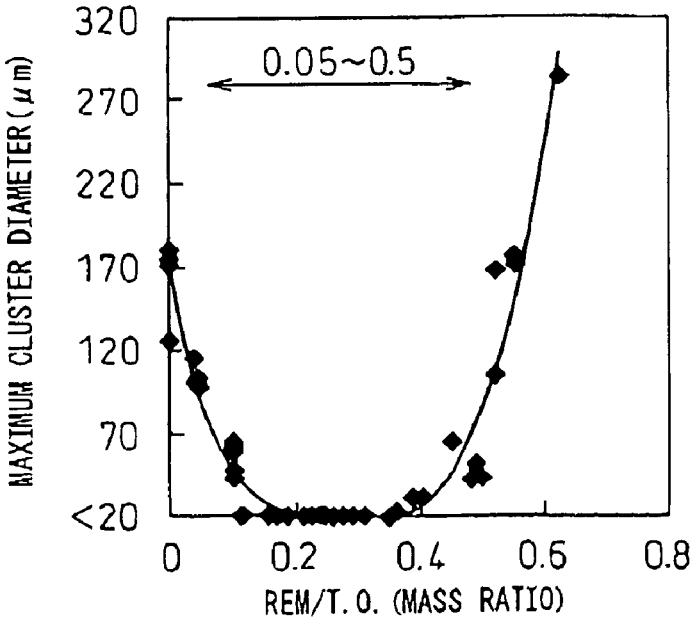
FIG. 2 shows the relationship between the ratio REM/T.O. and the maximum diameter of alumina clusters.

The upper limit of the REM/T.O. ratio is set to 0.5 because clusters consisting mainly of REM-oxides as coarse as those in ordinary steels treated by ordinary Al deoxidation are formed if the ratio exceeds 0.5, as shown in FIG. 2.

Meanwhile, the lower limit of the REM/T.O. ratio is set to 0.05 because addition of REM does not bring about the desired effect to prevent the clustering of alumina particles if the ratio is under 0.05, as also shown in FIG. 2.

T.O. is the total oxygen in steel that is the sum of oxygen dissolved in steel and oxygen contained in inclusions as described earlier.

The present invention described in (3) above (hereinafter referred to the present invention (3)) controls total REM-content to not less than 0.1 ppm and under 10 ppm and dissolved REM to under 1 ppm by adding one or more rare-earth metals (REMs) selected from the group of Ce, La, Pr and Nd to liquid steel deoxidized with Al or a combination of Al and Si.

When total REM-content and dissolved REM are controlled within these ranges, agglomeration and coalescence of alumina particles can be inhibited and formation of coarse alumina clusters prevented. Also, deterioration of liquid steel cleanliness due to a reaction between dissolved REM and slags can be prevented.

Formation of coarse alumina clusters can be more surely prevented if total REM-content is controlled to less than 5 ppm.

Figure 3:
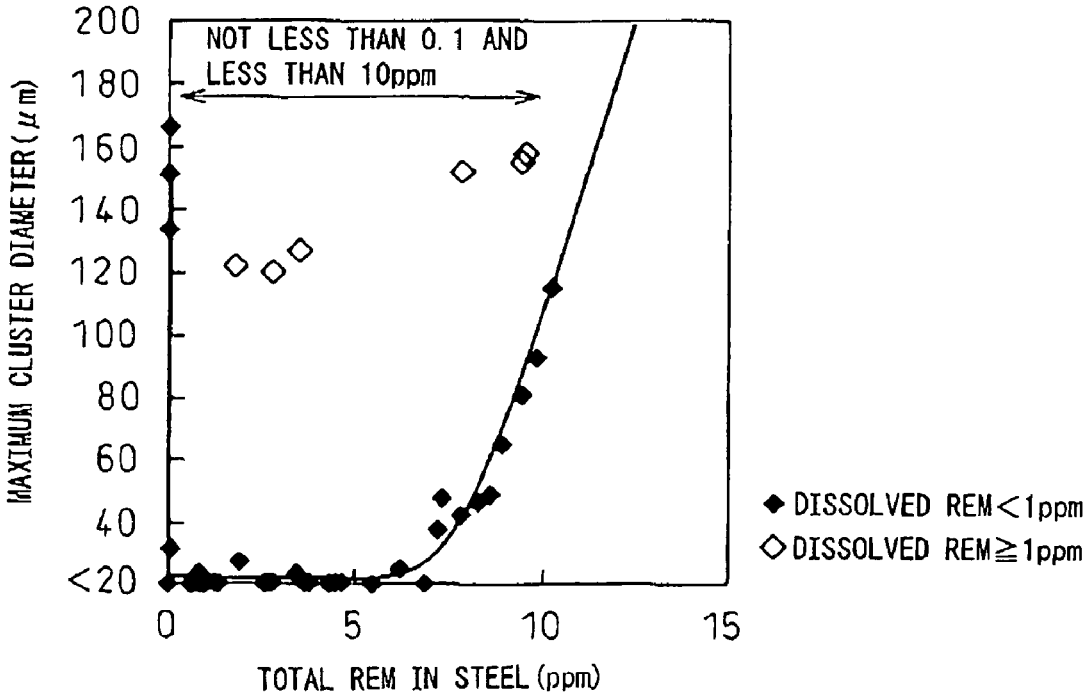
FIG. 3 shows the relationship between the total REM and the maximum diameter of alumina clusters in steel.

The upper limit of total REM-content is set to under 10 ppm because the concentration of REM-oxides in oxide-based inclusions increases, the likelihood of alumina particles agglomeration and coalescence increases and coarse clusters are formed if the content is 10 ppm or above, as shown in FIG. 3. Meanwhile, the lower limit of total REM-content is set to 0.1 ppm because addition of REM does not bring about the desired effect to prevent the clustering of alumina particles if the content is under 0.1 ppm, as also shown in FIG. 3.

To prevent the formation of coarse alumina clusters more surely, it is preferable to control total REM to less than 5 ppm.

Figure 4:
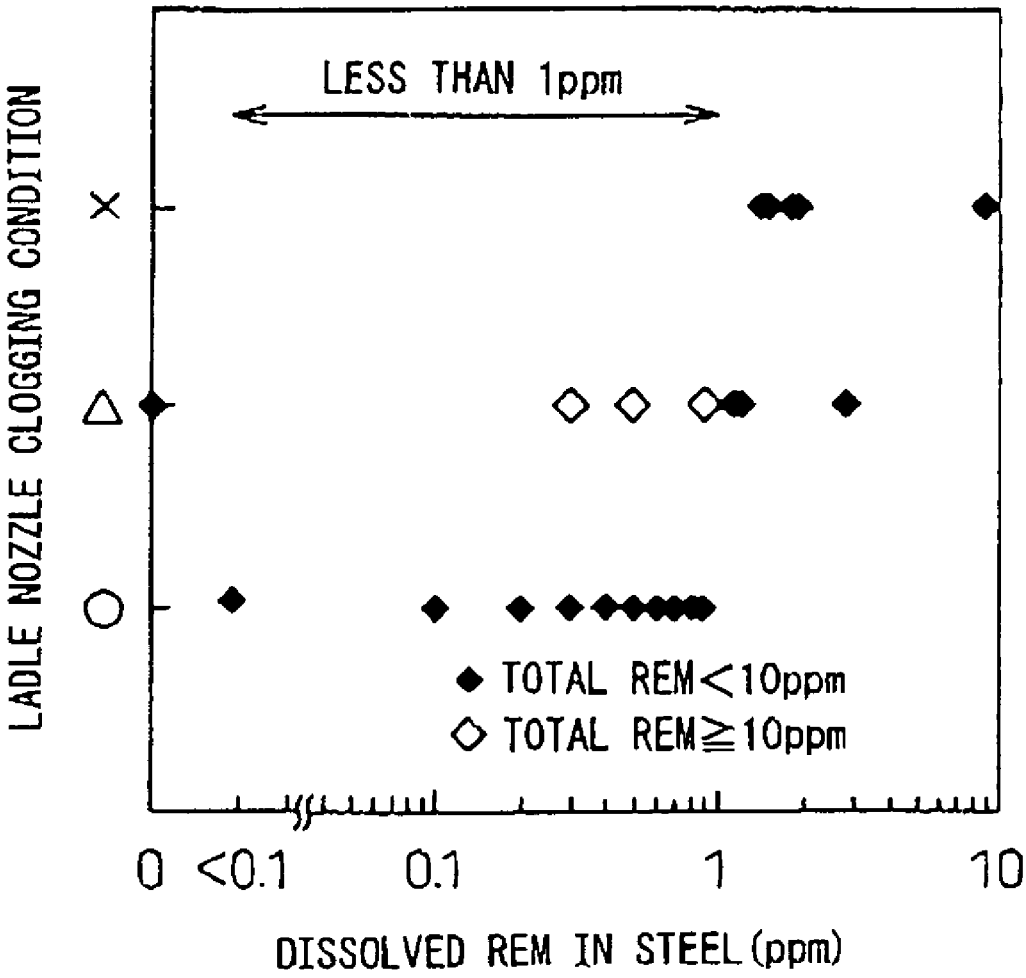
FIG. 4 shows the relationship between the quantity of dissolved REM in steel and the clogging condition of the ladle nozzle.

Dissolved REM is controlled to less than 1 ppm because slags and dissolved REM in liquid steel react to produce large quantities of composite oxides of REM-oxides and alumina, thereby forming coarse clusters and deteriorating the cleanliness of liquid steel if dissolved REM exceeds 1 ppm. Also, ladle nozzle clogging occurs, as shown in FIG. 4.

The liquid steels deoxidized with Al, as used in the present invention, contain, all in mass %, C of 0.0005 to 1.5%, Si of 0.005 to 1.2%, Mn of 0.05 to 3.0%, P of 0.001 to 0.1%, S of 0.0001 to 0.05%, Al of 0.005 to 1.5% and T.O. under 80 ppm, and further contain, as required, one or more element groups selected from three element groups (a) one or more of Cu of 0.1 to 1.51, Ni of 0.1 to 10.0%, Cr of 0.1 to 10.0%, and Mo of 0.05 to 1.5%, (b) one or more of Nb of 0.005 to 0.1%, V of 0.005 to 0.3%, and Ti of 0.001 to 0.25%, and (c) B of 0.0005 to 0.005%, with the remainder comprising iron and unavoidable impurities. The above liquid steels can be cast and rolled to sheets, plates, tubes, shapes, bars and other forms of products.

The above composition ranges are preferable for the following reasons:

C is a basic element that increases the strength of steel. C-content is controlled between 0.0005 and 1.5% depending on the desired level of strength. To insure the desired strength or hardness, it is preferable to control C-content to not less than 0.0005%. Meanwhile, C-content should be kept below 1.5% because toughness is impaired if the content is over 1.5%.

Si-content is controlled to between 0.005 and 1.2% because decreasing Si-content to below 0.005 is costly and impairs economic viability, whereas Si-content over 1.2% tends to result in defective coating and, therefore, surface quality and corrosion resistance deterioration.

Mn-content is controlled to between 0.05 and 3.0% because Mn-content under 0.05% necessitates longer refining time and impairs economic viability, whereas Mn-content over 3.0% significantly deteriorates the workability of rolled steels.

P-content is controlled to between 0.001 and 0.1% because F-content under 0.001% necessitates longer time and more cost in preliminary treatment of liquid steel and thereby impairs economic viability, whereas P-content over 0.1% significantly deteriorates the workability of rolled steels.

S-content is controlled to between 0.0001 and 0.05% because S-content less than 0.0001% necessitates longer time and more cost in preliminary treatment of liquid steel and thereby impairs economic viability, whereas S-content over 0.05% significantly deteriorates the workability and the corrosion resistance of rolled steels.

Al-content is controlled to between 0.005 and 1.5% because N is trapped as AlN and therefore it becomes difficult to decrease soluble nitrogen if Al-content is less than 0.005%. Meanwhile, Al-content over 1.5% causes deterioration of surface properties and the workability of rolled steels.

T.O. (Total oxygen) is controlled to not more than 80 ppm because T.O. of more than 80 ppm increases the collision frequency of alumina particles and thereby results in formation of coarse clusters. Also, T.O. of more than 80 ppm increases the addition of REM required for alumina reforming and thereby impairs economic viability.

While the foregoing are the basic components of the steels according to the present invention, one or more element groups selected from three element groups (a) one or more of Cu, Ni, Cr and Mo, (b) one or more of Nb, V and Ti, and (c) B may also be added as required.

Cu, Ni, Cr and Mo are elements that increase the hardenability of steel. Adding Cu, Ni and Cr of not less than 0.1% and Mo of not less than 0.05% increases the strength of steel.

However, Cu-addition is limited to between 0.1 and 1.5%, Ni- and Cr-addition to between 0.1 and 10%, and Mo-addition to between 0.05 and 1.15% because Cu and to addition of more than 1.5% and Ni and Cr addition of more than 10% impair toughness and workability.

Nb, V and Ti are elements that increase the strength of steel by precipitation hardening. Adding Nb and V of not less than 0.005% and Ti of not less than 0.001% increases the hardness of steel.

However, Nb-addition is controlled to between 0.005 and 0.1%, V-addition to between 0.005 and 0.3% and Ti-addition to between 0.001 and 0.25% because Nb-addition of more than 0.0.1%, V-addition of more than 0.3% and Ti-addition of more than 0.25 impair toughness.

B is an element that increases hardenability and strength. Adding B of not less than 0.0005% increases the strength of steel.

However, B-addition is controlled to between 0.0005 and 0.005% because B addition of more than 0.005% increases B-precipitates and thereby impairs toughness of steel.

It is further preferable for the present invention to control the maximum diameter of alumina clusters obtained by application of slime extraction to cast steel to not more than 100 μm, because alumina clusters larger than 100 μm tend to result in surface and internal defects when rolled steels are finished to final products.

It is also preferable for the present invention to control the number of alumina clusters obtained by application of slime extraction and are not smaller than 20 μm in size to not more than 2/kg. If the number is greater than 2/kg, surface and internal defects are likely to develop after rolling.

REMs are added to liquid steel after the liquid steel has been deoxidized by using such secondary refining apparatus as CAS or RH refining systems. REMs may be added as pure metals such as Ce and La or alloys of REMs or with other metals in lumps, particles, wires or other forms.

As the quantity of REMs added is very small, it is preferable to make uniform the REM-concentration in liquid steel by adding REMs to the refluxing liquid steel in the RH refining vessel or adding to the liquid steel in a ladle that is stirred with Ar or other gases. REMs may also be added to the liquid steel in the tundish or mold.

EXAMPLES

Example 1

Liquid steel was blown in a 270 t converter and tapped after the C-content was adjusted to the desired level. After the liquid steel has been adjusted to desired compositions by secondary refining and deoxidized with Al, REMs were added as Ce, La, misch metal (an alloy comprising, for example, Ce of 45 mass %, La of 35 mass %, Pr of 6 mass %, Nd of 9 mass % and unavoidable impurities) or alloy of misch metal, Si—Fe alloy (Fe—Si-30% REM). Table 1 shows the compositions of the liquid steels thus obtained.

The liquid steels of the compositions listed in Table 1 were cast to slabs 245 mm thick with widths of 1200 to 2200 mm by using a vertical-bending type continuous caster having a copper mold with a casting speed of 1.0 to 1.8 m/min and the liquid steel in the tundish kept at 1520 to 1580° C.

The slabs were hot-rolled, pickled and, as required, cold-rolled, and then subjected to quality investigation. The thickness after hot-rolling was 2 to 10 mm and that after cold-rolling was 0.2 mm.

The maximum cluster diameter, number of clusters, average composition of impurities and defect incidence were investigated with samples taken from the slabs. Table 2 shows the results obtained.

Table 2 shows that the present invention significantly decreases the product defects resulting from alumina clusters.

Notes *1 to *7 in Tables 1 and 2 have the following meanings:

*1: REM is the sum of Ce, La, Pr and Nd.

*2: MM is a mish metal that is an alloy comprising Ce of 45 mass %, La of 35 mass %, Pr of 6 mass %, Nd of 9 mass % and unavoidable impurities. MMSi is an alloy comprising REM of 30 mass % and Si of 30 mass %, with the remainder comprising Fe.

*3: Average composition of ten inclusions randomly extracted from the cross-section of slabs and identified by SEM (scanning electron microscope) with EDX (energy dispersive x-ray analysis).

*4: The maximum cluster diameter was determined by photographing inclusions extracted from (1±0.1) kg slabs by slime electrolysis (using minimum mesh of 20 μm) through a stereoscopic microscope (at a magnification of 40×) and finding the arithmetic mean of the major and minor axes of all inclusions photographed. The greatest arithmetic mean was determined as the maximum cluster diameter.

The number of clusters is the number of inclusions extracted from (1±0.1) kg slabs by slime electrolysis (using minimum mesh of 20 μm). The number of all inclusions larger than 20 μm observed under an optical microscope (at a magnification of 100×) was converted to the number per kilogram.

*5: The defect incidence was derived by using the following equation:

Sheet: Incidence of slivers at the surface of sheet[=(total length of slivers/Coil length)×100(%)]

Plate: Incidence of UST defects or separations on plate[=(Number of plates with defects/Total number of plates inspected)×100(%)]

The presence of separation was checked by observing the fractured surfaces after the Charpy test.

In the defect incidence column of plates, UST defects and separation defects are respectively designated by (UST) and (SPR).

Tube: Incidence of UST defects in welds of oil-well tubes[=(Number of tubes with defects/Total number of tubes inspected)×100(%)]

*6: V notch Charpy impact value in the rolling direction at −20° C. Arithmetic means of five test specimens.

*7: Reduction in area in the direction of thickness of finished plate at room temperature[=(Cross-sectional area of fractured portion after tensile test/Cross-sectional area of test specimen before tensile test)×100(%)]

TABLE 1

| | | Product | Composition of Steel (in mass %, REM and T.O. in ppm, with remainder comprising iron and unavoidable impurities) | | | | | | | | | Metal adding |
|---|---|---|---|---|---|---|---|---|---|---|---|---|
| | No. | Form | C | Si | Mn | P | S | T.Al | Special Element | REM *1 | T.O. | REM *2 |
| Example of the invention | A1 | Sheet | 0.0005 | 0.035 | 0.55 | 0.017 | 0.0057 | 0.050 | Ti: 0.006 | 3 | 27 | MMSi alloy |
| Example of the invention | A2 | Sheet | 0.002 | 0.005 | 0.76 | 0.027 | 0.0114 | 0.020 | Ti: 0.01 | 5 | 20 | MMSi alloy |
| Example of the invention | A3 | Sheet | 0.004 | 0.011 | 0.14 | 0.040 | 0.0171 | 0.070 | Ti: 0.012 | 11 | 35 | MMSi alloy |
| Example of the invention | A4 | Sheet | 0.007 | 0.019 | 0.33 | 0.007 | 0.0219 | 0.034 | Ti: 0.01 | 9 | 21 | MMSi alloy |
| Example of the invention | A5 | Sheet | 0.002 | 0.013 | 0.36 | 0.039 | 0.0133 | 0.066 | Ti: 0.03 | 12 | 25 | MM |
| Example of the invention | A6 | Sheet | 0.004 | 0.018 | 0.53 | 0.032 | 0.0190 | 0.035 | Ti: 0.045 | 20 | 33 | MMSi alloy |
| Example of the invention | A7 | Sheet | 0.006 | 0.032 | 0.81 | 0.042 | 0.0238 | 0.015 | Ti: 0.003 | 17 | 24 | MMSi alloy |
| Example of the invention | A8 | Sheet | 0.001 | 0.006 | 0.11 | 0.005 | 0.0048 | 0.055 | Ti: 0.01 | 37 | 42 | Cc |
| Example of the invention | A9 | Sheet | 0.019 | 0.077 | 0.65 | 0.015 | 0.0038 | 0.055 | | 3 | 25 | MMSi alloy |
| Example of the invention | A10 | Sheet | 0.038 | 0.006 | 0.91 | 0.024 | 0.0105 | 0.030 | | 8 | 18 | MMSi alloy |
| Example of the invention | A11 | Sheet | 0.067 | 0.030 | 0.15 | 0.038 | 0.0276 | 0.090 | | 2 | 17 | MMSi alloy |
| Example of the invention | A12 | Sheet | 0.095 | 0.053 | 0.40 | 0.005 | 0.0238 | 0.032 | | 5 | 22 | MMSi alloy |
| Example of the invention | A13 | Sheet | 0.029 | 0.005 | 0.13 | 0.017 | 0.0152 | 0.045 | | 5 | 15 | MMSi alloy |
| Example of the invention | A14 | Sheet | 0.048 | 0.038 | 0.43 | 0.033 | 0.0181 | 0.066 | | 8 | 18 | MMSi alloy |
| Example of the invention | A15 | Sheet | 0.124 | 0.057 | 0.69 | 0.044 | 0.0219 | 0.058 | | 6 | 14 | MM |
| Example of the invention | A16 | Sheet | 0.010 | 0.084 | 0.88 | 0.006 | 0.0057 | 0.066 | | 10 | 19 | MMSi alloy |
| Example of the invention | A17 | Sheet | 0.007 | 0.013 | 0.16 | 0.033 | 0.0143 | 0.087 | | 9 | 16 | MMSi alloy |
| Example of the invention | A18 | Sheet | 0.029 | 0.038 | 0.39 | 0.042 | 0.0067 | 0.075 | | 14 | 21 | MMSi alloy |
| Example of the invention | A19 | Sheet | 0.029 | 0.075 | 0.58 | 0.013 | 0.0060 | 0.034 | | 18 | 23 | MMSi alloy |
| Example of the invention | A20 | Sheet | 0.037 | 0.007 | 0.88 | 0.026 | 0.0110 | 0.056 | | 29 | 33 | La |
| Example of the invention | A21 | Plate | 0.280 | 0.290 | 1.08 | 0.011 | 0.0030 | 0.005 | Cr: 0.5 | 2 | 19 | MMSi alloy |
| Example of the invention | A22 | Plate | 0.270 | 0.300 | 1.10 | 0.010 | 0.0040 | 0.013 | Cr: 0.48 | 5 | 20 | MMSi alloy |
| Example of the invention | A23 | Plate | 0.300 | 0.680 | 2.53 | 0.009 | 0.0050 | 1.200 | Cr: 0.46 | 6 | 15 | MMSi alloy |

TABLE 1-continued

| | No. | Product Form | Composition of Steel (in mass %, REM and T.O. in ppm, with remainder comprising iron and unavoidable impurities) C | Si | Mn | P | S | T.Al | Special Element | REM *1 | T.O. | Metal adding REM *2 |
|---|---|---|---|---|---|---|---|---|---|---|---|---|
| Example of the invention | A24 | Plate | 0.110 | 0.250 | 0.90 | 0.010 | 0.0050 | 0.065 | Cu: 0.2, Ni: 0.85, Cr: 0.45 Mo: 0.35, V: 0.04, B: 0.001 | 4 | 9 | MMSi alloy |
| Example of the invention | A25 | Plate | 0.060 | 0.250 | 0.61 | 0.012 | 0.0040 | 0.040 | Ni: 9.25 | 9 | 12 | MM |
| Example of the invention | A26 | Plate | 0.070 | 0.050 | 1.20 | 0.008 | 0.0005 | 0.030 | Mo: 0.25, Nb: 0.015, V: 0.025 | 11 | 13 | La |
| Example of the invention | A27 | Tube | 0.513 | 0.360 | 1.18 | 0.008 | 0.0238 | 0.008 | Ti: 0.015 | 4 | 35 | MMSi alloy |
| Example of the invention | A28 | Tube | 0.551 | 0.019 | 1.69 | 0.010 | 0.0460 | 0.009 | Ti: 0.045 | 10 | 28 | MMSi alloy |
| Example of the invention | A29 | Tube | 0.589 | 0.135 | 0.13 | 0.014 | 0.0460 | 0.006 | Ti: 0.25 | 22 | 42 | MMSi alloy |
| Example of the invention | A30 | Tube | 0.618 | 0.252 | 0.66 | 0.004 | 0.0300 | 0.006 | Ti: 0.16 | 43 | 56 | MM |
| Example of the invention | A31 | Tube | 0.561 | 0.153 | 0.67 | 0.005 | 0.0504 | 0.008 | Ti: 0.07 | 34 | 42 | MMSi alloy |
| Example of the invention | A32 | Tube | 0.580 | 0.243 | 1.24 | 0.011 | 0.0390 | 0.005 | Ti: 0.038 | 32 | 36 | Ce |
| Example for comparison | B1 | Sheet | 0.0005 | 0.011 | 0.14 | 0.027 | 0.0219 | 0.050 | Ti: 0.012 | 0 | 35 | — |
| Example for comparison | B2 | Sheet | 0.002 | 0.013 | 0.36 | 0.019 | 0.0133 | 0.030 | Ti: 0.03 | 2 | 28 | MMSi alloy |
| Example for comparison | B3 | Sheet | 0.031 | 0.022 | 0.21 | 0.010 | 0.0114 | 0.020 | Ti: 0.03 | 22 | 22 | La |
| Example for comparison | B4 | Sheet | 0.038 | 0.053 | 0.40 | 0.038 | 0.0124 | 0.080 | Ti: 0.045 | 16 | 13 | MMSi alloy |
| Example for comparison | B5 | Sheet | 0.002 | 0.025 | 0.60 | 0.020 | 0.0238 | 0.032 | Ti: 0.03 | 69 | 81 | MMSi alloy |
| Example for comparison | B6 | Plate | 0.270 | 0.280 | 1.11 | 0.008 | 0.0050 | 0.028 | Cr: 0.51 | 0 | 12 | — |
| Example for comparison | B7 | Plate | 0.290 | 0.310 | 1.06 | 0.012 | 0.0040 | 0.015 | Cr: 0.48 | 1 | 9 | MMSi alloy |
| Example for comparison | B8 | Plate | 0.310 | 0.270 | 1.07 | 0.010 | 0.0030 | 0.022 | Cr: 0.49 | 15 | 14 | MM |
| Example for comparison | B9 | Plate | 0.100 | 0.230 | 0.88 | 0.008 | 0.0050 | 0.062 | Cu: 0.18, Ni: 0.83, Cr: 0.44 Mo: 0.32, V: 0.03, B: 0.0015 | 0 | 12 | — |
| Example for comparison | B10 | Plate | 0.055 | 0.590 | 0.27 | 0.012 | 0.0040 | 0.035 | Ni: 9.33 | 1 | 9 | MMSi alloy |
| Example for comparison | B11 | Plate | 0.072 | 0.052 | 1.26 | 0.010 | 0.0030 | 0.022 | Mo: 0.35, Nb: 0.023, V: 0.022 | 15 | 14 | MM |
| Example for comparison | B12 | Tube | 0.562 | 0.145 | 0.11 | 0.012 | 0.0340 | 0.006 | Ti: 0.12 | 0 | 38 | — |
| Example for comparison | B13 | Tube | 0.480 | 0.370 | 0.19 | 0.009 | 0.0238 | 0.080 | Ti: 0.018 | 3 | 35 | MMSi alloy |
| Example for comparison | B14 | Tube | 0.637 | 0.144 | 1.35 | 0.002 | 0.0220 | 0.005 | Ti: 0.045 | 41 | 42 | Ce |

TABLE 2

| | No. | Composition of Inclusions *3, mass % $Al_2O_3$ | REM-oxide | Maximum Cluster Diameter *4, μm | Number of Clusters *4, Piece/kg | Defect Incidence *5, % | Shock Absorption Energy *6, J | Reduction in Area across Plate Thickness *7, % |
|---|---|---|---|---|---|---|---|---|
| Example of the invention | A1 | 96.3 | 0.5 | 62 | 1.2 | 0.20 | — | — |
| Example of the invention | A2 | 96.6 | 2.4 | ≦20 | 0.0 | 0.11 | — | — |
| Example of the invention | A3 | 94.3 | 3.9 | ≦20 | 0.0 | 0.08 | — | — |
| Example of the invention | A4 | 84.8 | 6.4 | ≦20 | 0.0 | 0.26 | — | — |
| Example of the invention | A5 | 90.3 | 7.3 | ≦20 | 0.0 | 0.18 | — | — |
| Example of the invention | A6 | 87.1 | 9.8 | ≦20 | 0.0 | 0.22 | — | — |
| Example of the invention | A7 | 67.8 | 11.3 | ≦20 | 0.0 | 0.25 | — | — |
| Example of the invention | A8 | 83.8 | 14.4 | 52 | 0.7 | 0.10 | — | — |
| Example of the invention | A9 | 90.7 | 0.5 | 65 | 2.0 | 0.23 | — | — |
| Example of the invention | A10 | 91.0 | 6.6 | ≦20 | 0.0 | 0.26 | — | — |
| Example of the invention | A11 | 96.2 | 0.6 | 48 | 1.1 | 0.21 | — | — |
| Example of the invention | A12 | 96.8 | 2.3 | ≦20 | 0.0 | 0.20 | — | — |
| Example of the invention | A13 | 94.3 | 3.9 | ≦20 | 0.0 | 0.09 | — | — |
| Example of the invention | A14 | 84.8 | 6.4 | ≦20 | 0.0 | 0.18 | — | — |
| Example of the invention | A15 | 91.6 | 6.0 | ≦20 | 0.0 | 0.11 | — | — |
| Example of the invention | A16 | 88.4 | 8.4 | ≦20 | 0.0 | 0.12 | — | — |
| Example of the invention | A17 | 90.0 | 9.0 | ≦20 | 0.0 | 0.16 | — | — |
| Example of the invention | A18 | 87.1 | 11.1 | ≦20 | 0.0 | 0.06 | — | — |
| Example of the invention | A19 | 78.6 | 12.6 | 31 | 0.1 | 0.11 | — | — |
| Example of the invention | A20 | 82.8 | 14.8 | 42 | 0.6 | 0.12 | — | — |
| Example of the invention | A21 | 94.9 | 1.9 | 43 | 1.0 | — | 39.8 | — |
| Example of the invention | A22 | 96.6 | 2.4 | ≦20 | 0.0 | — | 40.2 | — |
| Example of the invention | A23 | 93.1 | 5.1 | ≦20 | 0.0 | — | 36.5 | — |
| Example of the invention | A24 | 84.3 | 6.9 | ≦20 | 0.0 | 9.1 (UST) | — | — |
| Example of the invention | A25 | 86.0 | 11.6 | 23 | 0.1 | 4.8 (SPR) | — | — |
| Example of the invention | A26 | 82.4 | 14.4 | 43 | 0.6 | — | — | 56.5 |
| Example of the invention | A27 | 98.5 | 0.5 | 59 | 1.0 | 0 | — | — |
| Example of the invention | A28 | 93.7 | 4.5 | ≦20 | 0.0 | 0.0 | — | — |
| Example of the invention | A29 | 83.3 | 7.9 | ≦20 | 0.0 | 0.2 | — | — |
| Example of the invention | A30 | 85.0 | 12.6 | 46 | 0.2 | 0.1 | — | — |
| Example of the invention | A31 | 83.5 | 13.3 | 31 | 0.2 | 0.2 | — | — |
| Example of the invention | A32 | 84.0 | 15.0 | 65 | 1.2 | 0.2 | — | — |

TABLE 2-continued

| | No. | Composition of Inclusions *3, mass % $Al_2O_3$ | REM-oxide | Maximum Cluster Diameter *4, μm | Number of Clusters *4, Piece/kg | Defect Incidence *5, % | Shock Absorption Energy *6, J | Reduction in Area across Plate Thickness *7, % |
|---|---|---|---|---|---|---|---|---|
| Example for comparison | B1 | 98.2 | 0.0 | 172 | 5.6 | 0.8 | — | — |
| Example for comparison | B2 | 91.0 | 0.2 | 115 | 3.1 | 0.6 | — | — |
| Example for comparison | B3 | 80.4 | 17.3 | 105 | 3.5 | 1.2 | — | — |
| Example for comparison | B4 | 74.9 | 22.0 | 284 | 7.5 | 1.4 | — | — |
| Example for comparison | B5 | 63.7 | 13.1 | 152 | 3.3 | 0.7 | — | — |
| Example for comparison | B6 | 99.0 | 0.0 | 181 | 6.8 | — | 21.6 | — |
| Example for comparison | B7 | 98.0 | 0.2 | 103 | 2.5 | — | 26.5 | — |
| Example for comparison | B8 | 78.1 | 19.2 | 172 | 4.8 | — | 22.3 | — |
| Example for comparison | B9 | 99.0 | 0.0 | 186 | 7.3 | 21.5 (UST) | — | — |
| Example for comparison | B10 | 98.0 | 0.2 | 108 | 3.0 | 13.6 (SPR) | — | — |
| Example for comparison | B11 | 72.1 | 19.2 | 167 | 4.3 | — | — | 31.0 |
| Example for comparison | B12 | 97.6 | 0.0 | 126 | 5.7 | 1.2 | — | — |
| Example for comparison | B13 | 91.1 | 0.2 | 101 | 2.9 | 1.4 | — | — |
| Example for comparison | B14 | 80.7 | 16.9 | 168 | 3.7 | 1.1 | — | — |

Example 2

Liquid steel was blown in =270 t converter and tapped after the C-content was adjusted to the desired level. After the liquid steel has been adjusted to desired composition by secondary refining and deoxidized with Al, REMs were added as Ce, La, misch metal (an alloy comprising, for example, Ce of 45 mass %, La of 35 mass %, Pr of 6 mass %, Nd of 9 mass % and unavoidable impurities) or alloy of misch metal, Si—Fe alloy (Fe—Si-30% REM). Table 3 shows the compositions of the liquid steels thus obtained.

The liquid steels of the compositions listed in Table 3 were cast to slabs 295 mm thick with widths of 1200 to 2200 mm by using a vertical-bending type continuous caster having a copper mold with a casting speed of 1.0 to 1.8 m/min and the liquid steel in the tundish kept at 1520 to 1580° C.

The maximum cluster diameter, number of clusters and clogging condition of immersion nozzles after casting were investigated with samples taken from the slabs. Table 4 shows the results obtained.

Table 4 shows that the present invention significantly decreases the product defects resulting from alumina clusters.

Notes *1 to *4 in Tables 3 and 4 have the following meanings:

*1: REM (total REM) is the sum of Ce, La, Pr and Nd. REM and T.O. are the analytical values obtained from samples of liquid steels taken within one minute after addition of REM.

*2: MM is a mish metal that is an alloy comprising Ce of 45 mass %, La of 35 mass % g, Pr of 6 mass %, Nd of 9 mass % and unavoidable impurities. MMSi is an alloy comprising REM of 30 mass % and Si of 30 mass %, with the remainder comprising iron.

*3: The maximum cluster diameter was determined by photographing inclusions extracted from (1±0.1) kg slabs by slime electrolysis (using minimum mesh of 20 μm) through a stereoscopic microscope (at a magnification of 40×) and finding the arithmetic mean of the major and minor axes of all inclusions photographed. The greatest arithmetic mean was determined as the maximum cluster diameter.

The number of clusters is the number of inclusions extracted from (1±0.1) kg slabs by slime electrolysis (using minimum mesh of 20 μm). The number of all inclusions larger than 20 μm observed under an optical microscope (at a magnification of 100×) was converted to the number per kilogram.

*4: The thickness of inclusions adhered to the inner wall of immersion nozzles was measured after casting. The clogging condition of nozzles was classified as follows based on the arithmetic means of thickness measured at 10 points distributed around the circumferential direction.

○: Thickness less than 1 mm

Δ: Thickness between 1 and 5 mm

X: Thickness more than 5 mm

TABLE 3

| | No. | Product Form | Composition of Steel (in mass %, REM and T.O. in ppm, with remainder comprising iron and unavoidable impurities) C | Si | Mn | P | S | T.Al | Special Element | REM/T.O *1 REM | T.O | | Metal Adding REMs *2 |
|---|---|---|---|---|---|---|---|---|---|---|---|---|---|
| Example of the invention | A1 | Sheet | 0.0005 | 0.035 | 0.55 | 0.017 | 0.0057 | 0.050 | Ti: 0.006 | 3 | 27 | 0.10 | MMSi alloy |
| Example of the invention | A2 | Sheet | 0.002 | 0.005 | 0.76 | 0.027 | 0.0114 | 0.020 | Ti: 0.01 | 2 | 20 | 0.12 | MMSi alloy |
| Example of the invention | A3 | Sheet | 0.004 | 0.011 | 0.14 | 0.040 | 0.0171 | 0.070 | Ti: 0.012 | 5 | 35 | 0.16 | MMSi alloy |
| Example of the invention | A4 | Sheet | 0.007 | 0.019 | 0.33 | 0.007 | 0.0219 | 0.034 | Ti: 0.01 | 5 | 21 | 0.22 | MMSi alloy |
| Example of the invention | A5 | Sheet | 0.002 | 0.013 | 0.36 | 0.019 | 0.0133 | 0.066 | Ti: 0.03 | 6 | 25 | 0.25 | MM |
| Example of the invention | A6 | Sheet | 0.004 | 0.018 | 0.53 | 0.032 | 0.0190 | 0.035 | Ti: 0.045 | 10 | 33 | 0.31 | MMSi alloy |
| Example of the invention | A7 | Sheet | 0.006 | 0.032 | 0.81 | 0.042 | 0.0238 | 0.015 | Ti: 0.003 | 8 | 24 | 0.35 | MMSi alloy |
| Example of the invention | A8 | Sheet | 0.001 | 0.006 | 0.11 | 0.005 | 0.0048 | 0.055 | Ti: 0.01 | 21 | 42 | 0.49 | Ce |
| Example of the invention | A9 | Sheet | 0.019 | 0.077 | 0.65 | 0.015 | 0.0038 | 0.055 | | 3 | 25 | 0.10 | MMSi alloy |
| Example of the invention | A10 | Sheet | 0.038 | 0.006 | 0.91 | 0.024 | 0.0205 | 0.030 | | 4 | 18 | 0.23 | MMSi alloy |

TABLE 3-continued

| | No. | Product Form | Composition of Steel (in mass %, REM and T.O. in ppm, with remainder comprising iron and unavoidable impurities) C | Si | Mn | P | S | T.Al | Special Element | REM/T.O *1 REM | T.O | | Metal Adding REMs *2 |
|---|---|---|---|---|---|---|---|---|---|---|---|---|---|
| Example of the invention | A11 | Sheet | 0.067 | 0.030 | 0.15 | 0.038 | 0.0276 | 0.090 | | 2 | 17 | 0.10 | MMSi alloy |
| Example of the invention | A12 | Sheet | 0.095 | 0.053 | 0.40 | 0.005 | 0.0238 | 0.032 | | 2 | 22 | 0.11 | MMSi alloy |
| Example of the invention | A13 | Sheet | 0.029 | 0.005 | 0.13 | 0.017 | 0.0152 | 0.045 | | 2 | 25 | 0.16 | MMSi alloy |
| Example of the invention | A14 | Sheet | 0.048 | 0.038 | 0.43 | 0.033 | 0.0181 | 0.066 | | 4 | 18 | 0.22 | MMSi alloy |
| Example of the invention | A15 | Sheet | 0.124 | 0.057 | 0.69 | 0.044 | 0.0219 | 0.058 | | 3 | 14 | 0.21 | MM |
| Example of the invention | A16 | Sheet | 0.010 | 0.084 | 0.88 | 0.006 | 0.0057 | 0.066 | | 5 | 19 | 0.28 | MMSi alloy |
| Example of the invention | A17 | Sheet | 0.007 | 0.013 | 0.16 | 0.033 | 0.0143 | 0.087 | | 5 | 16 | 0.29 | MMSi alloy |
| Example of the invention | A18 | Sheet | 0.029 | 0.038 | 0.39 | 0.042 | 0.0067 | 0.075 | | 7 | 21 | 0.35 | MMSi alloy |
| Example of the invention | A19 | Sheet | 0.019 | 0.075 | 0.58 | 0.013 | 0.0060 | 0.034 | | 9 | 23 | 0.39 | MMSi alloy |
| Example of the invention | A20 | Sheet | 0.037 | 0.007 | 0.88 | 0.026 | 0.0110 | 0.056 | | 16 | 33 | 0.48 | La |
| Example of the invention | A21 | Plate | 0.280 | 0.290 | 1.08 | 0.011 | 0.0030 | 0.005 | Cr: 0.5 | 2 | 19 | 0.10 | MMSi alloy |
| Example of the invention | A22 | Plate | 0.270 | 0.300 | 1.10 | 0.010 | 0.0040 | 0.013 | Cr: 0.48 | 2 | 20 | 0.12 | MMSi alloy |
| Example of the invention | A23 | Plate | 0.300 | 0.680 | 2.53 | 0.009 | 0.0050 | 1.200 | Cr: 0.46 | 3 | 15 | 0.19 | MMSi alloy |
| Example of the invention | A24 | Plate | 0.110 | 0.250 | 0.90 | 0.010 | 0.0050 | 0.065 | Cu: 0.2, Ni: 0.85, Cr: 0.45 Mo: 0.35, V: 0.04, B: 0.001 | 2 | 9 | 0.24 | MMSi alloy |
| Example of the invention | A25 | Plate | 0.060 | 0.250 | 0.61 | 0.012 | 0.0040 | 0.040 | Ni: 9.25 | 4 | 12 | 0.36 | MM |
| Example of the invention | A26 | Plate | 0.070 | 0.050 | 1.20 | 0.008 | 0.0005 | 0.030 | Mo: 0.25, Nb: 0.015, V: 0.02 | 7 | 13 | 0.50 | La |
| Example of the invention | A27 | Tube | 0.513 | 0.360 | 1.18 | 0.008 | 0.0238 | 0.008 | Ti: 0.015 | 4 | 35 | 0.10 | MMSi alloy |
| Example of the invention | A28 | Tube | 0.551 | 0.019 | 1.69 | 0.010 | 0.0460 | 0.009 | Ti: 0.045 | 5 | 28 | 0.17 | MMSi alloy |
| Example of the invention | A29 | Tube | 0.589 | 0.135 | 0.13 | 0.014 | 0.0460 | 0.006 | Ti: 0.25 | 11 | 42 | 0.26 | MMSi alloy |
| Example of the invention | A30 | Tube | 0.618 | 0.252 | 0.66 | 0.004 | 0.0300 | 0.006 | Ti: 0.16 | 27 | 56 | 0.49 | MM |
| Example of the invention | A31 | Tube | 0.561 | 0.153 | 0.67 | 0.005 | 0.0504 | 0.008 | Ti: 0.07 | 17 | 42 | 0.41 | MMSi alloy |
| Example of the invention | A32 | Tube | 0.580 | 0.243 | 1.24 | 0.011 | 0.0390 | 0.005 | Ti: 0.038 | 16 | 36 | 0.45 | Ce |
| Example for comparison | B1 | Sheet | 0.0005 | 0.011 | 0.14 | 0.027 | 0.0219 | 0.050 | Ti: 0.012 | 0 | 35 | 0.00 | — |
| Example for comparison | B2 | Sheet | 0.002 | 0.013 | 0.36 | 0.019 | 0.0133 | 0.030 | Ti: 0.03 | 1 | 29 | 0.04 | MMSi alloy |
| Example for comparison | B3 | Sheet | 0.031 | 0.022 | 0.21 | 0.010 | 0.0114 | 0.020 | Ti: 0.03 | 11 | 22 | 0.52 | La |
| Example for comparison | B4 | Sheet | 0.038 | 0.053 | 0.40 | 0.038 | 0.0124 | 0.080 | Ti: 0.045 | 8 | 13 | 0.63 | MMSi alloy |
| Example for comparison | B5 | Plate | 0.270 | 0.280 | 1.11 | 0.008 | 0.0050 | 0.028 | Cr: 0.51 | 0 | 12 | 0.00 | — |
| Example for comparison | B6 | Plate | 0.290 | 0.310 | 1.06 | 0.012 | 0.0040 | 0.015 | Cr: 0.48 | 0 | 9 | 0.05 | MMSi alloy |
| Example for comparison | B7 | Plate | 0.310 | 0.270 | 1.07 | 0.010 | 0.0030 | 0.022 | Cr: 0.49 | 8 | 14 | 0.55 | MM |
| Example for comparison | B8 | Plate | 0.100 | 0.230 | 0.88 | 0.008 | 0.0050 | 0.062 | Cu: 0.18, Ni: 0.83, Cr: 0.44 Mo: 0.32, V: 0.03, B: 0.0015 | 0 | 12 | 0.00 | — |
| Example for comparison | B9 | Plate | 0.055 | 0.590 | 0.27 | 0.012 | 0.0040 | 0.035 | Ni: 9.33 | 0 | 9 | 0.05 | MMSi alloy |
| Example for comparison | B10 | Plate | 0.072 | 0.052 | 1.26 | 0.010 | 0.0030 | 0.022 | Mo: 0.35, Nb: 0.023, V: 0.02 | 8 | 14 | 0.55 | MM |
| Example for comparison | B11 | Tube | 0.562 | 0.145 | 0.11 | 0.012 | 0.0340 | 0.006 | Ti: 0.12 | 0 | 38 | 0.00 | — |
| Example for comparison | B12 | Tube | 0.480 | 0.370 | 0.19 | 0.009 | 0.0238 | 0.080 | Ti: 0.018 | 1 | 35 | 0.04 | MMSi alloy |
| Example for comparison | B13 | Tube | 0.637 | 0.144 | 1.35 | 0.002 | 0.0220 | 0.005 | Ti: 0.045 | 22 | 42 | 0.52 | Ce |

TABLE 4

| | No. | Maximum Cluster Diameter *3, μm | Number of Clusters *3, Pieces/kg | Clogging Condition of Immersion Nozzle *4 |
|---|---|---|---|---|
| Example of the Invention | A1 | 62 | 1.2 | ○ |
| Example of the Invention | A2 | ≦20 | 0.0 | ○ |
| Example of the Invention | A3 | ≦20 | 0.0 | ○ |
| Example of the Invention | A4 | ≦20 | 0.0 | ○ |
| Example of the Invention | A5 | ≦20 | 0.0 | ○ |
| Example of the Invention | A6 | ≦20 | 0.0 | ○ |
| Example of the Invention | A7 | ≦20 | 0.0 | ○ |
| Example of the Invention | A8 | 52 | 0.7 | ○ |
| Example of the Invention | A9 | 65 | 0.9 | ○ |
| Example of the Invention | A10 | ≦20 | 0.0 | ○ |
| Example of the Invention | A11 | 48 | 1.1 | ○ |
| Example of the Invention | A12 | ≦20 | 0.0 | ○ |
| Example of the Invention | A13 | ≦20 | 0.0 | ○ |
| Example of the Invention | A14 | ≦20 | 0.0 | ○ |
| Example of the Invention | A15 | ≦20 | 0.0 | ○ |
| Example of the Invention | A16 | ≦20 | 0.0 | ○ |
| Example of the Invention | A17 | ≦20 | 0.0 | ○ |
| Example of the Invention | A18 | ≦20 | 0.0 | ○ |

TABLE 4-continued

| | No. | Maximum Cluster Diameter *3, μm | Number of Clusters *3, Pieces/kg | Clogging Condition of Immersion Nozzle *4 |
|---|---|---|---|---|
| Example of the Invention | A19 | 31 | 0.1 | ○ |
| Example of the Invention | A20 | 42 | 0.8 | ○ |
| Example of the Invention | A21 | 43 | 1.0 | ○ |
| Example of the Invention | A22 | ≦20 | 0.0 | ○ |
| Example of the Invention | A23 | ≦20 | 0.0 | ○ |
| Example of the Invention | A24 | ≦20 | 0.0 | ○ |
| Example of the Invention | A25 | 23 | 0.1 | ○ |
| Example of the Invention | A26 | 43 | 0.6 | ○ |
| Example of the Invention | A27 | 59 | 1.0 | ○ |
| Example of the Invention | A28 | ≦20 | 0.0 | ○ |
| Example of the Invention | A29 | ≦20 | 0.0 | ○ |
| Example of the Invention | A30 | 46 | 0.2 | ○ |
| Example of the Invention | A31 | 31 | 0.2 | ○ |
| Example of the Invention | A32 | 65 | 1.2 | ○ |
| Example for comparison | B1 | 172 | 5.6 | X |
| Example for comparison | B2 | 115 | 3.1 | Δ |
| Example for comparison | B3 | 105 | 3.5 | Δ |
| Example for comparison | B4 | 294 | 7.5 | X |

TABLE 4-continued

| | No. | Maximum Cluster Diameter *3, μm | Number of Clusters *3, Pieces/kg | Clogging Condition of Immersion Nozzle *4 |
|---|---|---|---|---|
| Example for comparison | B5 | 181 | 6.8 | X |
| Example for comparison | B6 | 103 | 2.5 | Δ |
| Example for comparison | B7 | 172 | 4.8 | X |
| Example for comparison | B8 | 176 | 6.3 | X |
| Example for comparison | B9 | 98 | 2.0 | Δ |
| Example for comparison | B10 | 177 | 5.3 | X |
| Example for comparison | B11 | 126 | 5.7 | X |
| Example for comparison | B12 | 101 | 2.9 | Δ |
| Example for comparison | B13 | 168 | 3.7 | X |

Example 3

Liquid steel was blown in a 270 t converter and tapped after the C-content was adjusted to the desired level. After the liquid steel has been adjusted to desired compositions by secondary refining and deoxidized with Al, REMs were added as Ce, La, misch metal (an alloy comprising, for example, Ce of 45 mass %, La of 35 mass %, Pr of 6 mass %, Nd of 9 mass % and unavoidable impurities) or alloy of misch metal, Si—Fe alloy (Fe—Si-30% REM). Table 5 shows the compositions of the liquid steels thus obtained.

The liquid steels of the compositions listed in Table 5 were cast to slabs 245 mm thick with widths of 1200 to 2200 mm by using a vertical-bending type continuous caster having a copper mold with a casting speed of 1.0 to 1.8 m/min and the liquid steel in the tundish kept at 1520 to 1580° C.

The slabs were hot-rolled, pickled and, as required, cold rolled, and then subjected to quality investigation. The thickness after hot rolling was 2 to 10 mm and that after cold rolling was 0.2 to 1.8 mm.

The maximum cluster diameter, number of clusters, defect incidence and clogging condition of ladle nozzles were investigated with samples taken from the slabs. Table 6 shows the results obtained.

Table 6 shows that the present invention significantly decreases the product defects resulting from alumina clusters.

Notes *1 to *7 in Tables 5 and 6 have the following meanings:

*1: Total REM is the sum of REM present in inclusions and dissolved REM in steel. Total REM was determined by drilling out a 1 g specimen from the central portion of a liquid steel sample, 30 mm diameter by 60 nm high, taken from the tundish and assaying REM (total of Ce, La, Pr and Nd) by inductively coupled plasma mass spectrometry (ICP-MS).

The lower limit of ICP-MS assay was 0.1 ppm for each element.

*2: Dissolved REM was determined as follows: After removing inclusions to the surface of samples by cold crucible melting, a 1 g specimen was taken from the central portion of the inclusion-free sample and dissolved REM was determined by assaying REM (total of Ce, La, Pr and Nd) by ICP-MS.

Specimens weighing 90 g each were taken from the central portion of liquid steel samples, 30 mm diameter by 60 mm high, taken from the tundish were melted in a cold crucible. Melting was carried out in an Ar-2% $H_2$ gas. Qualitatively detected REM elements below the lower limit of assaying are indicated as "<0.1 ppm" in the table.

Details of cold crucible melting is reported, for example, in CAMP-ISIJ, 14 (2001), p. 817.

*3: The maximum cluster diameter was determined by photographing inclusions extracted from (1±0.1) kg slabs by slime electrolysis (using minimum mesh of 20 μm) through a stereoscopic microscope (at a magnification of 40×) and finding the arithmetic mean of the major and minor axes of all inclusions photographed. The greatest arithmetic mean was determined as the maximum cluster diameter.

The number of clusters is the number of inclusions extracted from (1±0.1) kg slabs by slime electrolysis (using minimum mesh of 20 μm). The number of all inclusions larger than 20 μm observed under an optical microscope (at a magnification of 100×) was converted to the number per kilogram.

*4: The defect incidence was derived by using the following equation:

Sheet: Incidence of slivers at the surface of sheet[=(total length of slivers/Coil length)×100(%)]

Plate: Incidence of UST defects or separations on plate[=(Number of plates with defects/Total number of plates inspected)×100(%)]

The presence of separation was checked by observing the fractured surfaces after the Charpy test.

In the defect incidence column of plates, UST defects and separation defects are respectively designated by (UST) and (SPR).

Tube: Incidence of UST defects in welds of oil-well tubes[=(Number of tubes with defects/Total number of tubes inspected)×100(%)]

*5: V notch Charpy impact value in the rolling direction at −20° C. Arithmetic means of five test specimens.

*6: Reduction in area in the direction of thickness of finished plate at room temperature[=(Cross-sectional area of fractured portion after tensile test/Cross-sectional area of test specimen before tensile test)×100(% Q)]

*7: Clogging conditions of ladle nozzles are as follows:

○ no clogging, Δ clogging without lowering casting speed, and X clogging lowering casting speed.

TABLE 5

| | No. | Product Form | Composition of Steel (in mass %, REM and T.O. in ppm, with remainder comprising iron and unavoidable impurities) C | Si | Mn | P | S | T.Al | Special Element | Total REM *1 | Dissolved REM *2 |
|---|---|---|---|---|---|---|---|---|---|---|---|
| Example of the invention | A1 | Sheet | 0.0005 | 0.035 | 0.55 | 0.017 | 0.0057 | 0.050 | Ti: 0.006 | 0.1 | <0.1 |
| Example of the invention | A2 | Sheet | 0.002 | 0.005 | 0.76 | 0.027 | 0.0114 | 0.020 | Ti: 0.01 | 2.6 | 0.3 |
| Example of the invention | A3 | Sheet | 0.004 | 0.011 | 0.14 | 0.040 | 0.0171 | 0.070 | Ti: 0.012 | 0.9 | 0.2 |
| Example of the invention | A4 | Sheet | 0.007 | 0.019 | 0.33 | 0.007 | 0.0219 | 0.034 | Ti: 0.01 | 6.2 | 0.5 |
| Example of the invention | A5 | Sheet | 0.002 | 0.013 | 0.36 | 0.019 | 0.0133 | 0.066 | Ti: 0.03 | 8.3 | 0.4 |
| Example of the invention | A6 | Sheet | 0.004 | 0.018 | 0.53 | 0.032 | 0.0190 | 0.035 | Ti: 0.045 | 9.5 | 0.7 |

TABLE 5-continued

| | No. | Product Form | Composition of Steel (in mass %, REM and T.O. in ppm, with remainder comprising iron and unavoidable impurities) C | Si | Mn | P | S | T.Al | Special Element | Total REM *1 | Dissolved REM *2 |
|---|---|---|---|---|---|---|---|---|---|---|---|
| Example of the invention | A7 | Sheet | 0.006 | 0.032 | 0.81 | 0.042 | 0.0238 | 0.015 | Ti: 0.003 | 7.8 | 0.6 |
| Example of the invention | A8 | Sheet | 0.001 | 0.006 | 0.11 | 0.005 | 0.0048 | 0.055 | Ti: 0.01 | 5.5 | 0.9 |
| Example of the invention | A9 | Sheet | 0.019 | 0.077 | 0.65 | 0.015 | 0.0038 | 0.055 | | 3.5 | 0.8 |
| Example of the invention | A10 | Sheet | 0.038 | 0.006 | 0.91 | 0.024 | 0.0105 | 0.030 | | 1.1 | 0.7 |
| Example of the invention | A11 | Sheet | 0.067 | 0.030 | 0.15 | 0.038 | 0.0276 | 0.090 | | 0.2 | <0.1 |
| Example of the invention | A12 | Sheet | 0.095 | 0.053 | 0.40 | 0.005 | 0.0238 | 0.032 | | 2.8 | 0.5 |
| Example of the invention | A13 | Sheet | 0.029 | 0.005 | 0.13 | 0.017 | 0.0152 | 0.045 | | 4.7 | 0.2 |
| Example of the invention | A14 | Sheet | 0.048 | 0.038 | 0.43 | 0.033 | 0.0181 | 0.066 | | 6.9 | 0.3 |
| Example of the invention | A15 | Sheet | 0.124 | 0.057 | 0.69 | 0.044 | 0.0219 | 0.058 | | 8.9 | 0.4 |
| Example of the invention | A16 | Sheet | 0.010 | 0.084 | 0.88 | 0.006 | 0.0057 | 0.066 | | 0.7 | 0.1 |
| Example of the invention | A17 | Sheet | 0.007 | 0.013 | 0.16 | 0.033 | 0.0143 | 0.087 | | 7.3 | 0.6 |
| Example of the invention | A18 | Sheet | 0.029 | 0.038 | 0.39 | 0.042 | 0.0067 | 0.075 | | 5.5 | 0.2 |
| Example of the invention | A19 | Sheet | 0.019 | 0.075 | 0.58 | 0.013 | 0.0060 | 0.034 | | 3.7 | 0.8 |
| Example of the invention | A20 | Sheet | 0.037 | 0.007 | 0.88 | 0.026 | 0.0110 | 0.056 | | 1.4 | 0.4 |
| Example of the invention | A21 | Plate | 0.280 | 0.290 | 1.08 | 0.011 | 0.0030 | 0.005 | Cr: 0.5 | 0.9 | <0.1 |
| Example of the invention | A22 | Plate | 0.270 | 0.300 | 1.10 | 0.010 | 0.0040 | 0.013 | Cr: 0.48 | 2.6 | 0.6 |
| Example of the invention | A23 | Plate | 0.300 | 0.680 | 2.53 | 0.009 | 0.0050 | 1.200 | Cr: 0.46 | 4.6 | 0.2 |
| Example of the invention | A24 | Plate | 0.110 | 0.250 | 0.90 | 0.010 | 0.0050 | 0.065 | Cu: 0.2, Ni: 0.85, Cr: 0.45 Mo: 0.35, V: 0.04, B: 0.001 | 6.2 | 0.8 |
| Example of the invention | A25 | Plate | 0.060 | 0.250 | 0.61 | 0.012 | 0.0040 | 0.040 | Ni: 9.25 | 8.6 | 0.4 |
| Example of the invention | A26 | Plate | 0.070 | 0.050 | 1.20 | 0.008 | 0.0005 | 0.030 | Mo: 0.25, Nb: 0.015, V: 0.025 | 9.8 | 0.9 |
| Example of the invention | A27 | Tube | 0.513 | 0.360 | 1.18 | 0.008 | 0.0238 | 0.008 | Ti: 0.015 | 7.2 | 0.6 |
| Example of the invention | A28 | Tube | 0.551 | 0.019 | 1.69 | 0.010 | 0.0460 | 0.009 | Ti: 0.045 | 5.5 | 0.6 |
| Example of the invention | A29 | Tube | 0.589 | 0.135 | 0.13 | 0.014 | 0.0460 | 0.006 | Ti: 0.25 | 3.8 | 0.8 |
| Example of the invention | A30 | Tube | 0.618 | 0.252 | 0.66 | 0.004 | 0.0300 | 0.006 | Ti: 0.16 | 1.1 | 0.4 |
| Example of the invention | A31 | Tube | 0.561 | 0.153 | 0.67 | 0.005 | 0.0504 | 0.008 | Ti: 0.07 | 2.0 | <0.1 |
| Example of the invention | A32 | Tube | 0.580 | 0.243 | 1.24 | 0.011 | 0.0390 | 0.005 | Ti: 0.038 | 4.4 | 0.2 |
| Example for comparison | B1 | Sheet | 0.0005 | 0.011 | 0.14 | 0.027 | 0.0219 | 0.050 | Ti: 0.012 | 0.0 | 0.0 |
| Example for comparison | B2 | Sheet | 0.002 | 0.013 | 0.36 | 0.019 | 0.0133 | 0.030 | Ti: 0.03 | 10.2 | 0.5 |
| Example for comparison | B3 | Sheet | 0.031 | 0.022 | 0.21 | 0.010 | 0.0114 | 0.020 | Ti: 0.03 | 3.5 | 1.2 |
| Example for comparison | B4 | Sheet | 0.038 | 0.053 | 0.40 | 0.038 | 0.0124 | 0.080 | Ti: 0.045 | 9.5 | 1.9 |
| Example for comparison | B5 | Sheet | 0.002 | 0.025 | 0.60 | 0.020 | 0.0238 | 0.032 | Ti: 0.03 | 51.3 | 11.5 |
| Example for comparison | B6 | Plate | 0.270 | 0.280 | 1.11 | 0.008 | 0.0050 | 0.028 | Cr: 0.51 | 0.0 | 0.0 |
| Example for comparison | B7 | Plate | 0.290 | 0.310 | 1.06 | 0.012 | 0.0040 | 0.015 | Cr: 0.48 | 18.2 | 0.9 |
| Example for comparison | B8 | Plate | 0.310 | 0.270 | 1.07 | 0.010 | 0.0030 | 0.022 | Cr: 0.49 | 9.4 | 1.4 |
| Example for comparison | B9 | Plate | 0.100 | 0.230 | 0.88 | 0.008 | 0.0050 | 0.062 | Cu: 0.18, Ni: 0.83, Cr: 0.44 Mo: 0.32, V: 0.03, B: 0.0015 | 1.8 | 1.1 |
| Example for comparison | B10 | Plate | 0.055 | 0.590 | 0.27 | 0.012 | 0.0040 | 0.035 | Ni: 9.33 | 19.8 | 9.0 |
| Example for comparison | B11 | Tube | 0.072 | 0.052 | 1.26 | 0.010 | 0.0030 | 0.022 | Ti: 0.038 | 15.4 | 0.3 |
| Example for comparison | B12 | Tube | 0.562 | 0.145 | 0.11 | 0.012 | 0.0340 | 0.006 | Ti: 0.12 | 0.0 | 0.0 |
| Example for comparison | B13 | Tube | 0.480 | 0.370 | 0.19 | 0.009 | 0.0238 | 0.080 | Ti: 0.018 | 2.8 | 1.5 |
| Example for comparison | B14 | Tube | 0.589 | 0.135 | 0.13 | 0.014 | 0.0460 | 0.006 | Ti: 0.25 | 7.8 | 2.8 |
| Example for comparison | B15 | Tube | 0.637 | 0.144 | 1.35 | 0.002 | 0.0220 | 0.005 | Ti: 0.045 | 41.2 | 1.8 |

TABLE 6

| | No. | Maximum Cluster Diameter *3, μm | Number of Clusters *3, Piece/kg | Defect Incident *4, % | Shock Absorption Energy *5, J | Reduction in Area across Plate Thickness *6, % | Ladle Nozzle Clogging Condition *7 |
|---|---|---|---|---|---|---|---|
| Example of the invention | A1 | <20 | 0.0 | 0.20 | — | — | ○ |
| Example of the invention | A2 | <20 | 0.0 | 0.11 | — | — | ○ |
| Example of the invention | A3 | <20 | 0.0 | 0.08 | — | — | ○ |
| Example of the invention | A4 | 25 | 0.2 | 0.26 | — | — | ○ |
| Example of the invention | A5 | 46 | 0.7 | 0.18 | — | — | ○ |
| Example of the invention | A6 | 81 | 1.6 | 0.22 | — | — | ○ |
| Example of the invention | A7 | 42 | 0.6 | 0.25 | — | — | ○ |
| Example of the invention | A8 | <20 | 0.0 | 0.10 | — | — | ○ |
| Example of the invention | A9 | 23 | 0.1 | 0.23 | — | — | ○ |

TABLE 6-continued

| | No. | Maximum Cluster Diameter *3, μm | Number of Clusters *3, Piece/kg | Defect Incident *4, % | Shock Absorption Energy *5, J | Reduction in Area across Plate Thickness *6, % | Ladle Nozzle Clogging Condition *7 |
|---|---|---|---|---|---|---|---|
| Example of the invention | A10 | <20 | 0.0 | 0.26 | — | — | ○ |
| Example of the invention | A11 | 31 | 0.4 | 0.21 | — | — | ○ |
| Example of the invention | A12 | <20 | 0.0 | 0.20 | — | — | ○ |
| Example of the invention | A13 | <20 | 0.0 | 0.09 | — | — | ○ |
| Example of the invention | A14 | 21 | 0.2 | 0.15 | — | — | ○ |
| Example of the invention | A15 | 65 | 1.1 | 0.11 | — | — | ○ |
| Example of the invention | A16 | 21 | 0.3 | 0.12 | — | — | ○ |
| Example of the invention | A17 | 48 | 0.5 | 0.16 | — | — | ○ |
| Example of the invention | A18 | <20 | 0.0 | 0.08 | — | — | ○ |
| Example of the invention | A19 | <20 | 0.0 | 0.11 | — | — | ○ |
| Example of the invention | A20 | <20 | 0.0 | 0.12 | — | — | ○ |
| Example of the invention | A21 | 24 | 0.4 | — | 39.8 | — | ○ |
| Example of the invention | A22 | <20 | 0.0 | — | 40.2 | — | ○ |
| Example of the invention | A23 | <20 | 0.0 | — | 36.5 | — | ○ |
| Example of the invention | A24 | 25 | 0.3 | 4.6(UST) | — | — | ○ |
| Example of the invention | A25 | 49 | 0.7 | 9.3(SPR) | — | — | ○ |
| Example of the invention | A26 | 93 | 1.8 | — | — | 58.5 | ○ |
| Example of the invention | A27 | 38 | 0.5 | 0.00 | — | — | ○ |
| Example of the invention | A28 | <20 | 0.0 | 0.00 | — | — | ○ |
| Example of the invention | A29 | <20 | 0.0 | 0.20 | — | — | ○ |
| Example of the invention | A30 | <20 | 0.0 | 0.10 | — | — | ○ |
| Example of the invention | A31 | 27 | 0.2 | 0.20 | — | — | ○ |
| Example of the invention | A32 | <20 | 0.0 | 0.20 | — | — | ○ |
| Example for comparison | B1 | 152 | 5.6 | 0.80 | — | — | Δ |
| Example for comparison | B2 | 115 | 3.1 | 0.60 | — | — | Δ |
| Example for comparison | B3 | 127 | 2.5 | 0.56 | — | — | Δ |
| Example for comparison | B4 | 158 | 3.9 | 0.60 | — | — | X |
| Example for comparison | B5 | 232 | 3.3 | 0.70 | — | — | X |
| Example for comparison | B6 | 134 | 6.8 | — | 21.6 | — | Δ |
| Example for comparison | B7 | 193 | 2.5 | — | 26.6 | — | Δ |
| Example for comparison | B8 | 155 | 4.8 | — | 22.3 | — | X |
| Example for comparison | B9 | 122 | 2.1 | 16.3(UST) | — | — | Δ |
| Example for comparison | B10 | 201 | 3.0 | 23.6(SPR) | — | — | X |
| Example for comparison | B11 | 172 | 4.3 | — | — | 31.0 | Δ |
| Example for comparison | B12 | 166 | 5.7 | 1.7 | — | — | Δ |
| Example for comparison | B13 | 120 | 2.9 | 1.4 | — | — | X |

TABLE 6-continued

| | No. | Maximum Cluster Diameter *3, μm | Number of Clusters *3, Piece/kg | Defect Incident *4, % | Shock Absorption Energy *5, J | Reduction in Area across Plate Thickness *6, % | Ladle Nozzle Clogging Condition *7 |
|---|---|---|---|---|---|---|---|
| Example for comparison | B14 | 152 | 3.5 | 1.6 | — | — | Δ |
| Example for comparison | B15 | 217 | 3.7 | 1.1 | — | — | X |

INDUSTRIAL APPLICABILITY

The present invention permits obtaining, from Al deoxidized steels, final steel products having very few surface and internal defects ascribable to coarse alumina clusters.

The present invention also prevents adhesion of alumina in liquid steel to immersion nozzles in continuous casting.

Thus, the present invention constitutes a great contribution to the development of industry by providing steel products with very few alumina clusters by eliminating the conventional problems associated with steels deoxidized with Al.

The invention claimed is:

1. A steel prepared by casting liquid steel deoxidized with Al, including one or more rare-earth metals (REMs) selected from the group of Ce, La, Pr and Nd, characterized by, the steel containing alumina clusters and consisting essentially of C of 0.0005 to 1.5 mass %, Si of 0.005 to 1.2 mass %, Mn of 0.05 to 3.0 mass %, P of 0.001 to 0.1 mass %, S of 0.0001 to 0.05 mass %, Al of 0.005 to 1.5 mass %, and total oxygen T.O. of less than 80 ppm, with the remainder iron and unavoidable impurities, where the alumina clusters are oxide-based inclusions consisting essentially of alumina and REM-oxide, the inclusions containing $Al_2O_3$ of not less than 78.6 mass % and REM-oxide of not less than 0.5 mass % and not more than 15 mass %, where the mass ratio of total REM to total oxygen REM/T.O. is not less than 0.05 and not more than 0.5, where total REM is not less than 0.1 ppm and less than 10 ppm and dissolved REM is less than 1 ppm.

2. The steel containing alumina clusters described in claim 1, in which said steel further contains one or more of Cu of 0.1 to 1.5 mass %, Ni of 0.1 to 10.0 mass %, Cr of 0.1 to 10.0 mass % and Mo of 0.05 to 1.5 mass %.

3. The steel containing alumina clusters described in claim 1, in which said steel further contains one or more of Nb of 0.005 to 0.1 mass %, V of 0.005 to 0.3 mass % and Ti of 0.001 to 0.25 mass %.

4. The steel containing alumina clusters described in claim 1, in which said steel further contains B of 0.0005 to 0.005 mass %.

5. The steel containing alumina clusters described in claim 1, in which the maximum diameter of alumina clusters obtained by applying slime extraction to said steel is less than 100 μm.

6. The steel containing alumina clusters described in claim 5, in which the number of alumina clusters not smaller than 20 μm is not more than 2/kg.

* * * * *